United States Patent [19]

Miller, Jr.

[11] Patent Number: 5,034,751

[45] **Date of Patent: * Jul. 23, 1991**

[54] AIRBORNE SURVEILLANCE PLATFORM

[75] Inventor: William McE. Miller, Jr., Princeton, N.J.

[73] Assignee: Aereon Corporation, Princeton, N.J.

[ * ] Notice: The portion of the term of this patent subsequent to Jan. 23, 2007 has been disclaimed.

[21] Appl. No.: 467,845

[22] Filed: Jan. 22, 1990

Related U.S. Application Data

[63] Continuation-in-part of Ser. No. 157,694, Feb. 19, 1988, Pat. No. 4,896,160.

[51] Int. Cl.[5] ..... H01Q 3/22

[52] U.S. Cl. ..... 342/368; 343/708

[58] Field of Search ..... 342/368; 343/708

[56] References Cited

U.S. PATENT DOCUMENTS

| | | | |
|---|---|---|---|
| Re. 28,454 | 6/1975 | Fitzpatrick et al. | 244/25 |
| 3,684,217 | 8/1972 | Kukon et al. | 244/36 |
| 3,761,041 | 9/1973 | Putman | 244/13 |
| 4,149,688 | 4/1979 | Miller, Jr. | 244/12.4 |
| 4,662,588 | 5/1987 | Henderson | 343/708 |
| 4,896,160 | 2/1990 | Miller, Jr. | 342/368 |

*Primary Examiner*—Thomas H. Tarcza
*Assistant Examiner*—David Cain
*Attorney, Agent, or Firm*—Howson and Howson

[57] ABSTRACT

An airborne surveillance platform utilizes a low aspect ratio delta-shaped aircraft having a radar-transparent hull. The antenna is located within, and stationary relative to, the hull. The antenna comprises planar or linear phased arrays arranged to scan in a continuous 360 degree pattern in all azimuthal directions or in a continuous 180 degree pattern in all forward azimuthal directions. Planar phased arrays can be arranged to scan in a continuous pattern in the range from zenith to nadir or in portions of that range. In the case of forward direction scanning, the antenna arrays are located immediately inside the radar-transparent leading edges of the aircraft hull, thereby allowing a large cargo space within the hull between the antenna arrays. Access to the cargo space is provided through an opening in the trailing edge.

7 Claims, 6 Drawing Sheets

FIG 5
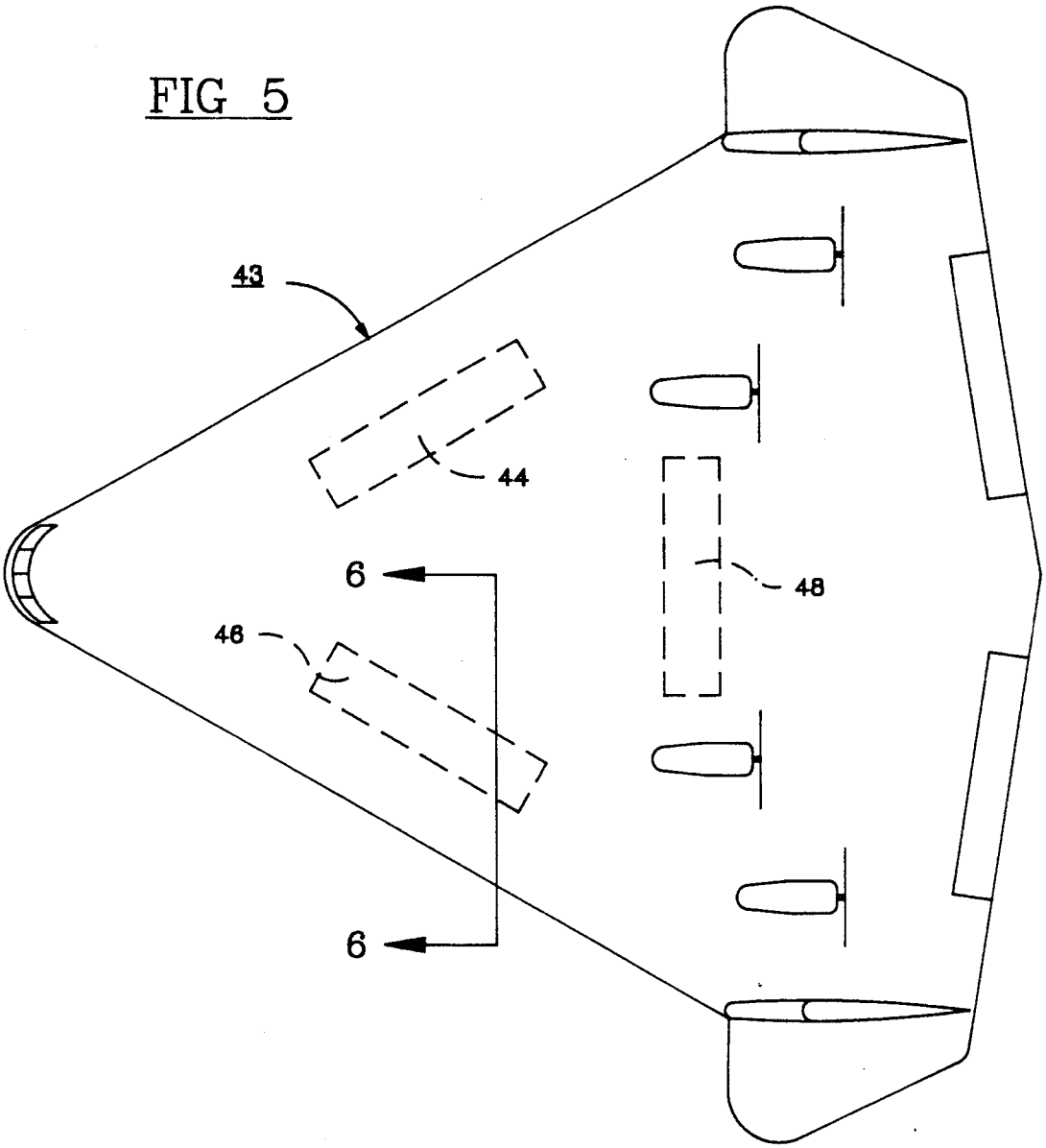
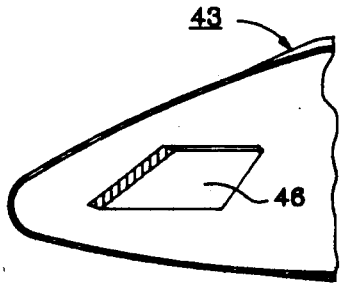
FIG 6
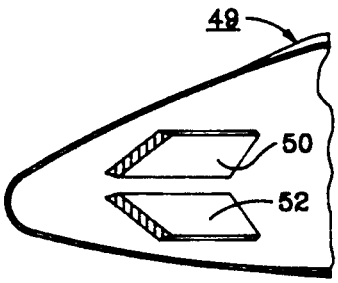
FIG 7

AIRBORNE SURVEILLANCE PLATFORM

CROSS-REFERENCE TO RELATED APPLICATION

This is a continuation-in-part of my application Ser. No. 157,694, filed Feb. 19, 1988, now U.S. Pat. No. 4,896,160, issued Feb. 23, 1990.

BRIEF SUMMARY OF THE INVENTION

This invention relates to surveillance by the detection of reflected radar signals or other radio signals emanating from a target. More specifically, the invention relates to an airborne surveillance antenna platform. An airborne surveillance antenna platform has particular utility in the detection and tracking of ballistic missiles and cruise missiles.

Airborne surveillance by radio signal detection has been carried out by means of mechanically steerable antennas. Such antennas are necessarily limited in size. Larger mechanically steerable antennas, when carried by an aircraft, are necessarily mounted externally, and create flight performance problems.

Modern phased array technology has been used to create surveillance antennas which are electronically steerable both in azimuth and elevation, with directional patterns equivalent to, or better than, those of a mechanically steerable antenna.

For missile detection and tracking, it is generally necessary to scan in all azimuthal directions. A practical phased array capable of scanning in all azimuthal directions, if carried by an aircraft of conventional size and shape, would necessarily be mounted on the exterior. It would be possible to mount a phased array within the interior of a gas-filled airship, if appropriate measures were taken to prevent the airship structure from interfering with antenna performance. However, an airship has both altitude and speed limitations, which seriously constrain its use as a surveillance platform.

While scanning in all azimuthal directions is generally desirable for missile tracking, there are circumstances in which scanning only of the space ahead of the aircraft is desired. However, conventional aircraft and airship configurations are not well suited even for carrying phased arrays capable only of forward scanning.

A conventional aircraft or airship, whether or not equipped with antenna arrays for airborne surveillance, has little or no room for large items of cargo, such as helicopters, for example.

One object of the present invention is to provide an airborne surveillance platform which meets the requirements of long endurance and high altitude flight capability, and which is capable of scanning in all azimuthal directions with a phased antenna array.

A further object of the invention is to provide for scanning in all azimuthal directions and also in a range of elevations, which may include the entire range from zenith to nadir, or a portion or portions of that range.

Still a further object of the invention is to provide an airborne surveillance platform capable of unmanned flight under remote control.

Still a further object of the invention is to provide an airborne surveillance platform capable of efficient scanning in a forward direction in all azimuthal directions through an arc of at least 180 degrees Still a further object of the invention is to provide an airborne surveillance platform which is capable of efficient scanning in a forward direction, and which also has a large interior cargo space.

In accordance with the invention, use is made of a low aspect ratio triangular aircraft hull configuration of the kind described in Reissue patent 28,454, dated June 17, 1975, and in U.S. Pat. Nos. 3,684,217, dated Aug. 15, 1972, 3,761,041, dated Sept. 25, 1973 and 4,149,688, dated Apr. 17, 1979. The disclosures of these patents are here incorporated by reference. Briefly, the hull configuration is characterized by a delta-shaped platform with a narrow nose at one corner, leading edges extending from the nose to the opposite corners, and a trailing edge extending between said opposite corners, the platform being substantially symmetrical about a plane of symmetry extending from said narrow nose to the midpoint of the trailing edge, ellipse-like cross-sections transverse to said plane throughout substantially all of the length of the hull, a maximum height dimension in said plane perpendicular to the chord in said plane at a location spaced from said trailing edge and from said nose, said ellipse-like cross-sections progressively decreasing in height, measured in said plane, throughout substantially the entire distance from the cross-section at the point of maximum height toward said trailing edge.

The aircraft structure in accordance with the invention utilized composite materials to provide a radar-transparent hull. Within the hull, a phased array antenna is provided. The delta-shaped palnform of the hull lends itself to optimum use of space by a triangular antenna comprising three arrays, one being arranged to scan through one of the leading edges, another being arranged to scan through the other leading edge, and a third being arranged to scan through the trailing edge. The triangular configuration of three arrays makes it possible to scan through 360 degrees in azimuthal directions by electronic steering. The deltoid platform for the triangular antenna inherently maximizes radar size for a given platform size, with a resultant enhancement of operability, maintainability and ground-basing of the system. The deltoid platform design also has the advantage of allowing cockpit, engines and fins to be out of the main path of microwave energy radiated from the antenna arrays.

Where scanning in the rearward direction, i.e. the direction opposite to the direction of flight, is unnecessary, the third antenna array can be eliminated, and the other two arrays used to scan through the respective leading edges. With these two arrays positioned close to the leading edges through which the scan, cargo space is available within the interior of the aircraft hull between the antenna arrays, and an access opening for the cargo space can be provided near the trailing edge.

Depending on the frequency ranges desired, different kinds of antenna arrays can be used. AT high frequencies, planar arrays offer the advantage of electrical steerability in both azimuth and elevation. Advantages of the invention can also be realized with linear phased arrays, one in each leading edge and, optionally, one in the trailing edge. Linear phased arrays so arranged are electrically steerable in azimuth only, but can operate at the longer radar wavelengths at which target resonance comes into play.

In one embodiment of the invention utilizing planar phased arrays, each of three planar antenna arrays is inclined t an angle of approximately 45 degrees relative to the horizon, so that scanning can take place not only in all azimuthal directions, but also from the zenith to below the horizon. Where it is desired to scan from the zenith to locations directly, or nearly directly below the surveillance platforms, six planar arrays may be used, consisting of three upper arrays capable of scanning from the zenith to the horizon, and three lower arrays capable of scanning from the horizon to the nadir. Alternatively, zenith to nadir scanning can be achieved using four planar phased arrays, three being inclined at 60 degrees relative to the horizon (30 degrees declination) and the remaining array being horizontal and directed upwardly.

In the case of linear phased arrays, two or three arrays are used. In each case, two linear phased arrays extend along the interiors of the respective leading edges of the aircraft. A third linear phased array can extend along the interior of the trailing edge.

Further objects and advantages of the invention will be apparent from the following detailed description, when read in conjunction with the drawings.

BRIEF DESCRIPTION OF THE DRAWINGS

FIG. 5 is a top plan view showing an alternative configuration of planar phased arrays in an airborne surveillance platform in accordance with the invention;

FIG. 6 is an diagrammatic sectional view taken on the plane 6—6 of FIG. 5;

FIG. 7 is a diagrammatic sectional view, similar to FIGS. 4 and 6, showing a further alternative antenna configuration;

DETAILED DESCRIPTION

Figure 1:
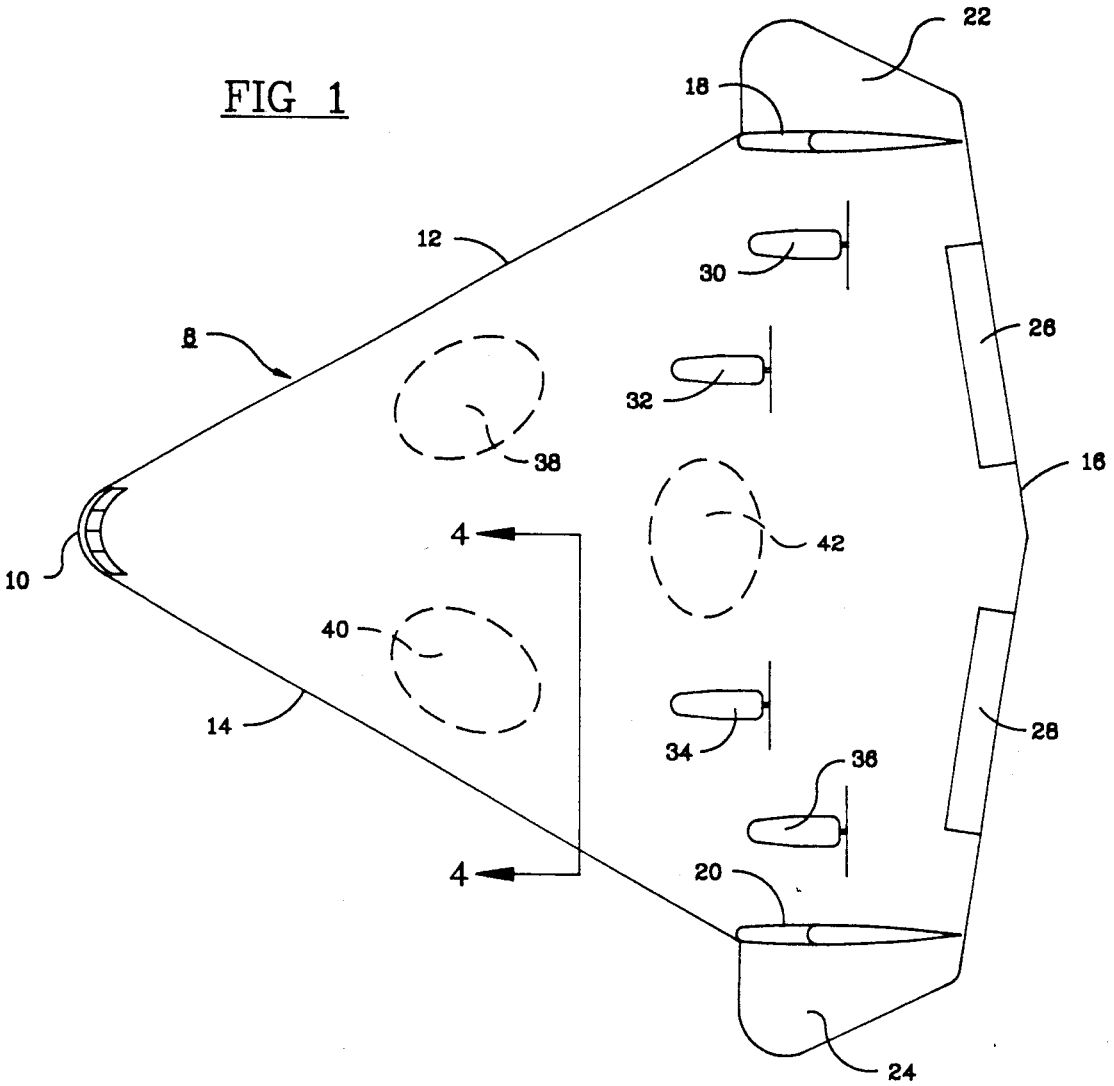
FIG. 1 is a top plan view illustrating one configuration of planar phased arrays in an airborne surveillance platform in accordance with the invention.
Figure 2:
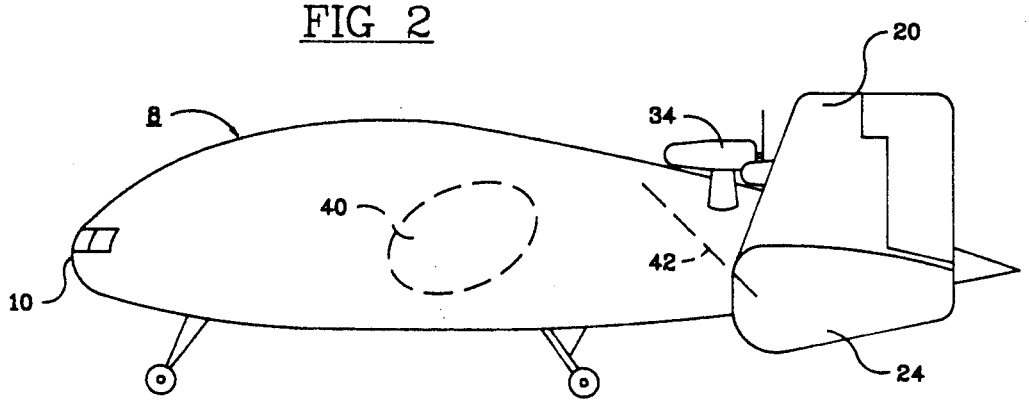
FIG. 2 is a side elevation of the airborne surveillance platform of FIG. 1.
Figure 3:
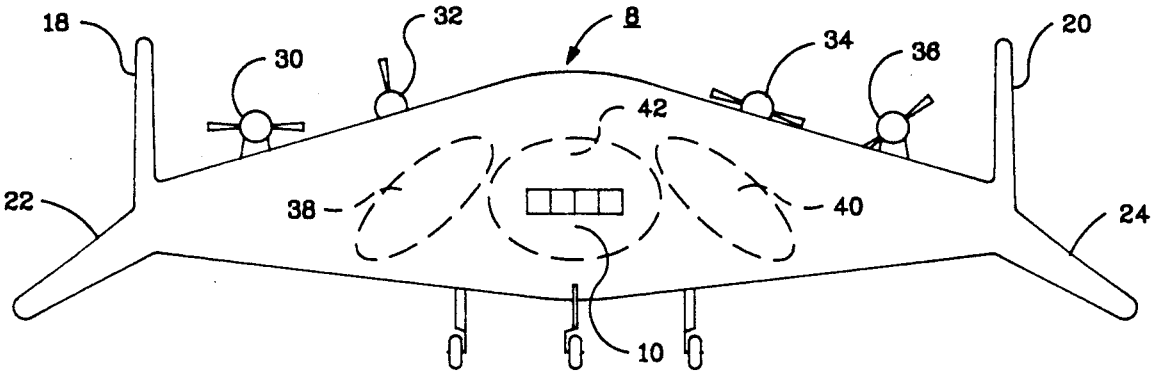
FIG. 3 is a front elevation of the airborne surveillance platform of FIG. 1.

As shown in FIGS. 1, 2 and 3, the airborne surveillance platform comprises a low aspect ratio aircraft hull 8 having a delta-shaped platform with a narrow nose 10. Leading edges 12 and 14 extend from the corner at which nose 10 is located to the opposite corners, between which there extends the trailing edge 16. Vertical stabilizers 18 and 20 are provided at the opposite ends of the trailing edge. Drooping airfoil surfaces 22 and 24 are also provided at the trailing edge, in accordance with U. S. Pat. No. 3,684,217, to compensate for excessive rolling moment due to the sideslip which results from the high sweep angle of the leading edges. Control surfaces are provided along the trailing edge at 26 and 28. On the upper surface of the body, propulsion units are provided at 30, 32, 34, and 36.

The hull structure of the aircraft preferably comprises a composite material consisting of a rigid foam or honeycomb core of radar-transparent polymer, having a facing on both sides of Kevlar, epoxy-embedded glass-fiber matrix, or a similar radar-transparent material. Supporting ribs and spars in the interior of the hull are also preferably formed from radar-transparent materials. An example of a suitable material for the internal ribs and spars is a glass-fiber reinforced epoxy resin. Such a resin can be formed into the desired spar or rib shape by a pultrusion process. Of course, parts of the aircraft hull and internal structure which do not affect performance of the internal antennas can be made of any desired material.

Figure 4:
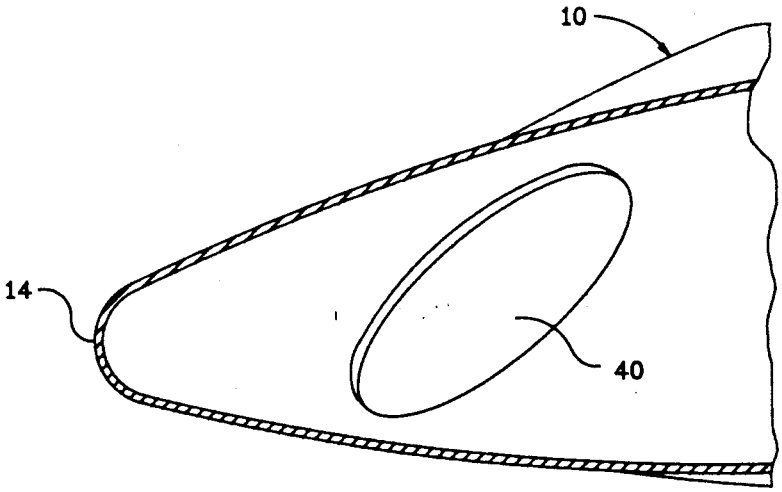
FIG. 4 is a diagrammatic vertical section taken on plane 4—4 of FIG.

As shown in FIG. 1, located within the aircraft hull are three planar antenna arrays 38, 40, 42. These three arrays are circular in shape, and identical to one another. Antenna array 40, as show in FIG. 4, is tilted at a 45 degree angle relative to the horizontal, so that array 40 faces upwardly and outwardly through leading edge 14. Array 38 is situated at a similar angle inside the opposite leading edge 12. Similarly, array 42 faces upwardly at a 45 degree angle through the upper surface of the hull, between propulsion units 32 and 34.

Tilting the planar antenna arrays so that, for example, they face upwardly at approximately 45 degree angles, has three important effects. First, it enables the antenna arrays to scan from the zenith to below the horizon. Second, it enables the arrays, although of larger dimensions, to fit inside the limited vertical space within the aircraft hull near the leading edges, and near the trailing edge. Third, tilting the arrays reduces the required overall hull dimensions. A system of antenna arrays of the same size, if arranged in vertical planes, would require a vastly larger hull.

The three planar antenna arrays 38, 40, 42 are situated in planes such that horizontal diameters of the circular arrays, if extended, would form an equilateral triangle. As a planar phased array can be electronically steered through a horizontal angle of approximately 120 degrees, situating the antenna arrays so that their diameters form parts of an equilateral triangle, make 360 degree azimuthal scanning coverage possible with only minimal beam degradation at the points of overlap.

The three planar antenna arrays need not be circular as in FIGS. 1–4. FIGS. 5 and 6 show, for example, a surveillance platform 43, similar to that in FIGS. 1–4, except that the three antenna arrays 44, 46, and 48 are in the form of elongated rectangles, each situated at a 45 degree angle relative to the horizontal, and have their long dimensions along the faces of an equilateral triangle.

Figure 8:
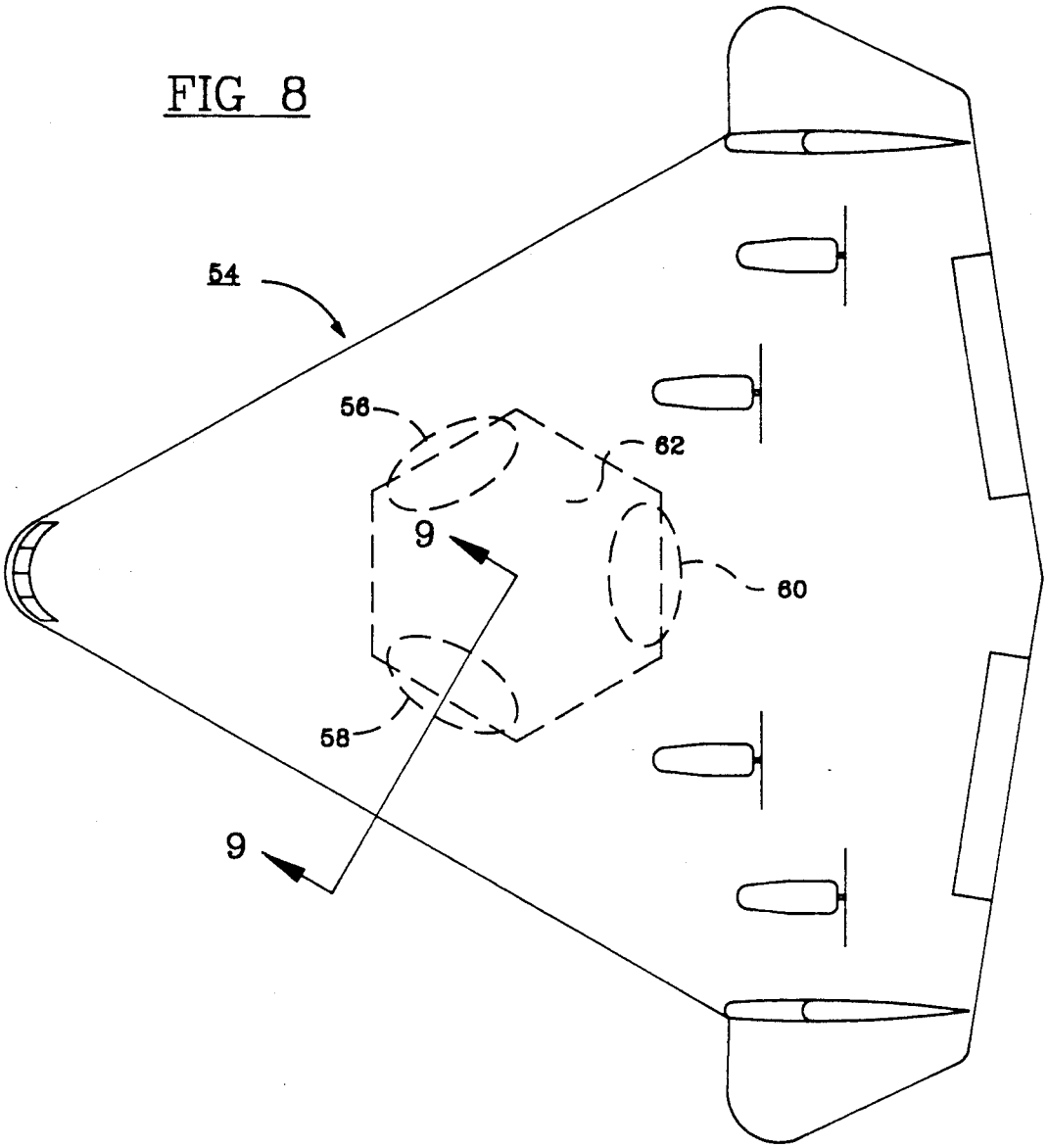
FIG. 8 is a top plan view showing a further alternative configuration of planar phased arrays.
Figure 9:
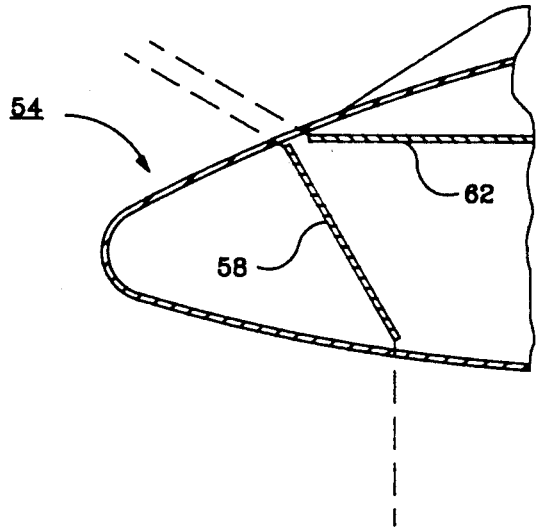
FIG. 9 is a diagrammatic sectional view taken of the plane 9—9 of FIG. 8.

In the alternative embodiment of FIG. 7, airborne surveillance platform 49 has, inside its port side leading edge, an upper planar antenna array 50 facing upwardly at a 45 degree angle, and a lower antenna array 52 facing downwardly at a 45 degree angle. Similar pairs of antenna arrays are provided inside the opposite leading edge, and inside the trailing edge. The antenna configuration of FIG. 7 is capable of scanning through a full 360 degrees of azimuth, and from the zenith to the nadir. Thus, it is omnidirectional. The configuration of FIG. 7 has particular utility in the detection and tracking of cruise missiles and other low flying missiles. An alternative way of achieving substantially omnidirectional scanning is shown in FIGS. 8 and 9, in which airborne surveillance platform 54 has four internal planar phased arrays. Three of the internal arrays, 56, 58, and 60 are circular, and arranged so that their horizontal diameters form parts of the sides of an equilateral triangle. As show in FIG. 9, planar array 58 is situated at an angle of 60 degrees relative to the horizonal, so that it faces downwardly at an angle of 30 degrees from the horizonal. This enables it to scan from 30 degrees above the horizon to 180 degrees below the horizon, or directly downwardly. Each of the other circular planar phased arrays 56 and 60 is similarly situated for scanning through a vertical range from 30 degrees above the horizon to 180 degrees below. The fourth planar phased array is hexagonal array 62, which is situated horizontally within the platform hull near the upper ends of planar arrays 56, 58, and 60. Horizontal array 62 can be electronically steered in all azimuthal directions and in elevations from 30 degrees above the horizon to 90 degrees, or directly upwardly. Thus, the four planar arrays of FIGS. 8 and 9 can act together to provide substantially omnidirectional scanning.

The designer has a wide variety of choices so far as the tilt angle of planar arrays is concerned. For example, if the direction of primary interest is in the vicinity of the horizon or slightly below the horizon, and the direction directly below the platform is not important, three planar arrays can be arranged at angles 70 degrees above the horizon (i.e. at a declination of 20 degrees). This will optimize performance of the antenna in directions 20 degrees below the horizon, and allow scanning from about 40 degrees above the horizon to 80 degrees below the horizon.

Figure 10:
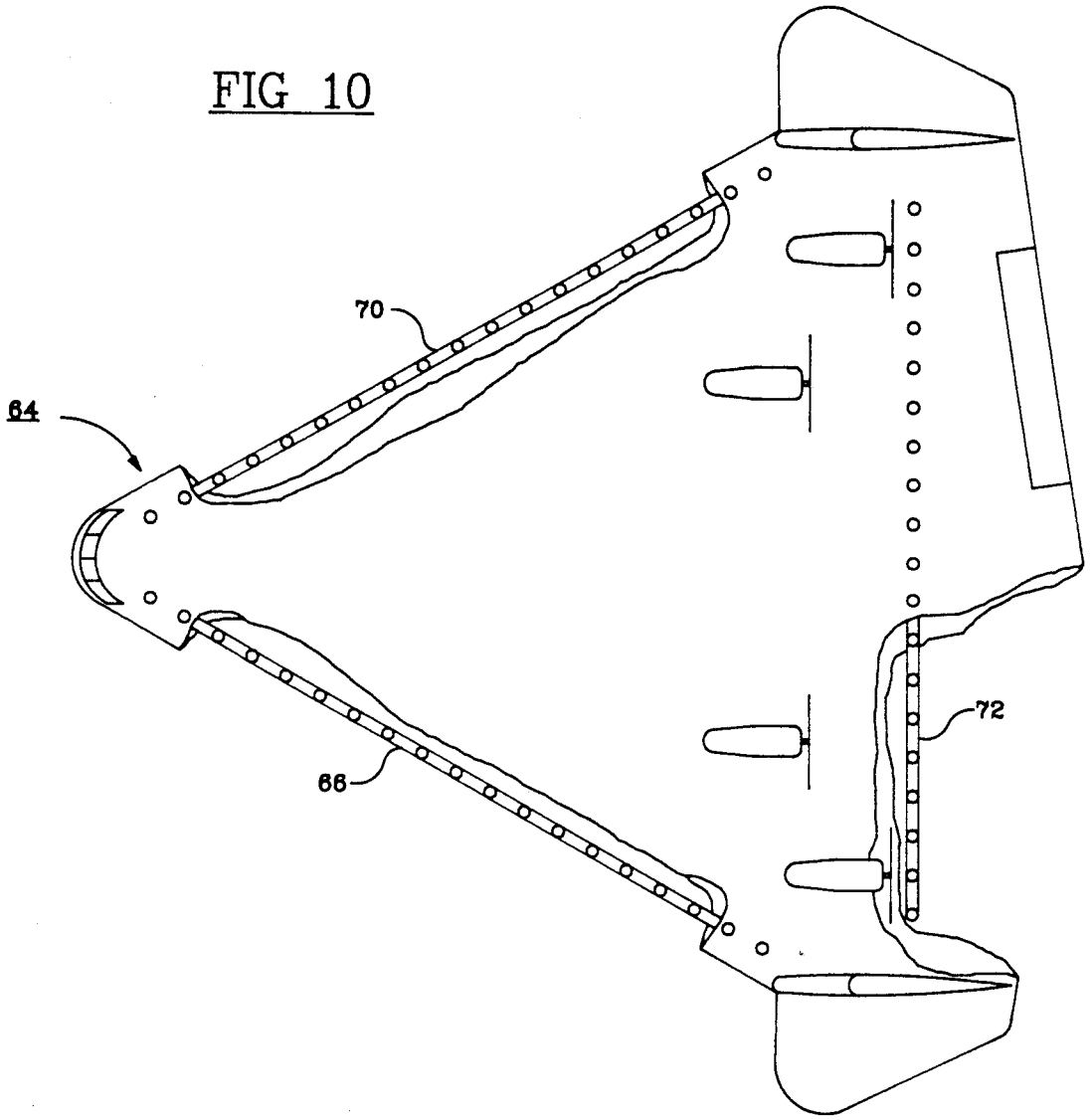
FIG. 10 is a partially broken away diagrammatic plan view of an airborne surveillance platform in accordance with the invention, utilizing three linear phased arrays.
Figure 11:
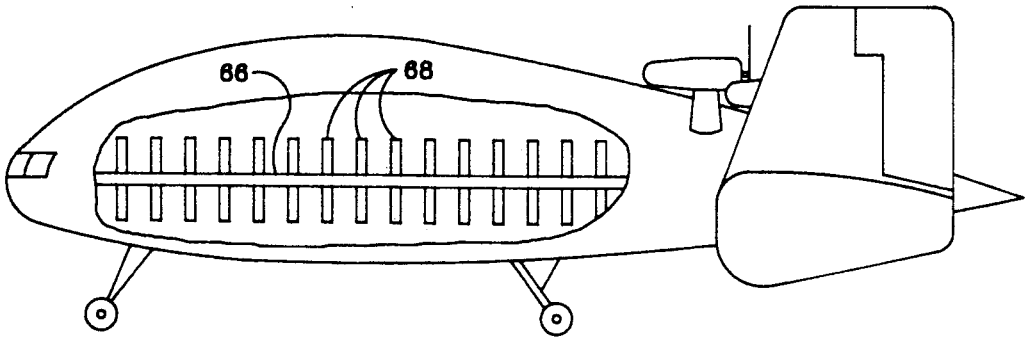
FIG. 11 is a partially broken away side elevation of the platform of FIG. 10.

FIGS. 10 and 11 show an airborne surveillance platform which utilizes three linear phased arrays for scanning in all azimuthal directions. Platform 64 is a delta-shaped aircraft similar to the aircraft of FIGS. 1-9. Inside its port side leading edge, there is provided a linear phased antenna array 66, which comprises a series of dipoles 68 interconnected with the radar transmitting and/or receiving apparatus in such a way that the main antenna lobe can be steered electronically through a wide horizontal range. A similar linear array 70 is provided inside the starboard side leading edge, and still another similar linear array 72 is provided inside the trailing edge. The three linear arrays, acting together, provide for electronically controlled scanning throughout a full 360 degree azimuthal range. The shape of the aircraft hull is such that the vertical space within the interior of the hull near the leading and trailing edges allows adequate room for the height of the vertical elongated dipole elements. If greater height is needed, the linear arrays can be positioned more toward the interior of the hull. If the antenna arrays are moved toward the interior of the hull, they must also be lengthened.

Figure 12:
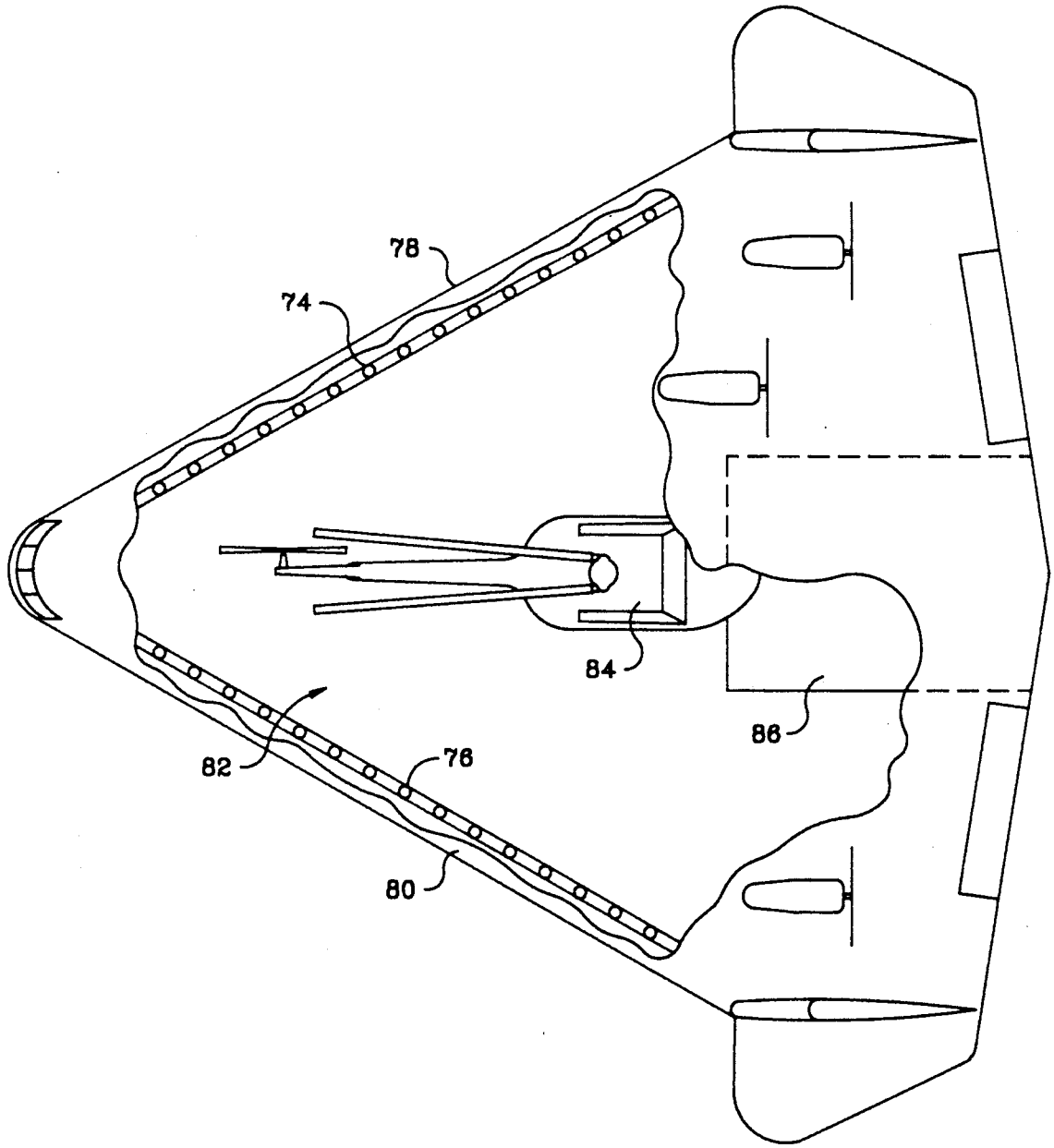
FIG. 12 is a partially broken away diagrammatic plan view of an airborne surveillance platform in accordance with the invention, utilizing linear phased arrays in the leading edges, and having an internal cargo space between the arrays with an access door near the trailing edge.

FIG. 12 shows an embodiment of the invention in which linear phased arrays 74 and 76 are provided inside radar-transparent transparent leading edges 78 and 80. The linear phased arrays are preferably aligned with the leading edges, and situated close to the leading edges to provide a large interior cargo space 82, suitable, for example, for containing a helicopter 84 with its rotor blades folded back. An access opening for the cargo space may be provided under the trailing edge, closeable by an access door 86 in the lower part of the hull. The two antenna arrays provide scanning in all forward azimuthal directions, i.e. through an arc of at least 180 degrees symmetrical about the vertical plane of symmetry of the aircraft platform. The two antenna arrays, of course, may also scan beyond the sideways directions toward the rear to some extent. For example, in the embodiment shown in FIG. 12, the antenna arrays may be capable of scanning through an arc of as much as 240 degrees.

The surveillance platform of FIG. 12 has potential utility in tactical situations where only forward scanning is of significance, and where bulky items of cargo need to be transported. Linear phased arrays, as shown in FIG. 12 are ideal where optimum cargo space is desired, because they fit well within the radar-transparent leading edges of the delta-shaped aircraft. However the advantages of forward scanning and high cargo-carrying capacity can also be realized with planar phased arrays, although their vertical dimensions may not permit them to fit as close to the leading edges of the aircraft hull as do the linear arrays. A reduction in the vertical dimensions of the planar phased arrays, with a consequent increase in available cargo space between them, can be achieved by the use of elliptically shaped planar phased arrays.

The surveillance platform in accordance with the invention carries antennas, having very large areas, internally, and in a configuration which allows the antennas to scan through a full 360 degrees in a continuous pattern in all azimuthal directions, or continuously through a 180 degree arc in forward directions. The large area of the antennas, made possible by the aircraft configuration, makes it possible to achieve highly directional electronically controlled scanning at microwave frequencies. The large dimensions of the platform also make it possible to utilize long wavelength radar antennas, which can be more effective than short wavelength radar in some situations.

The deltoid platform configuration and the triangular antenna array allow the cockpit, engines and fins to be located out of the main path of radiated microwave energy. This reduces the chance of injury to the crew and interference with radar performance by the metallic parts of the engines and fins. Blind spots will result for close distances. However, the beams of adjacent arrays can be made to converge, thereby eliminating blind spots at greater distances.

While the preferred embodiments of the invention, shown, in FIGS. 1-12, utilize three, four or six planar antenna arrays, or two or three linear arrays, it is possible to realize many of the advantages of the invention with other radar antenna arrays such as, for example, ring-shaped radar antennas. A typical ring-shaped radar antenna is thirty feet high and fifty feet in diameter. It cannot be accommodated inside a conventional aircraft, but can be easily accommodated inside a triangular aircraft as herein described, if approximately centered at the location of the maximum vertical dimension of the aircraft hull. The invention is applicable both to radar surveillance in which an outgoing signal is generated and its reflection received and analyzed, and to passive surveillance, in which signals generated in a target are received and analyzed.

The angle formed by the two leading edges of the aircraft hull is preferably close to 60 degrees, resulting in an aspect ratio in the range of approximately 1.7 to 2.3, depending primarily on the shape of the trailing edge structure. This angle, however, can be modified considerably to achieve desired flight performance and other aircraft characteristics without impairing the performance of the internal antenna arrays. Preferably, the aircraft hull is designed with an aspect ratio of 2.0 or less.

Still further alternative antenna configurations can be used, and other modifications made to the aircraft hull, without departing from the scope of the invention as defined in the following claims.

I claim:

1. An airborne surveillance platform comprising an aircraft hull having a delta-shaped platform with a narrow nose at one corner, first and second radar-transparent leading edges extending respectively from the nose to the opposite corners, and a trailing edge extending between said opposite corners, the platform being substantially symmetrical about a plane of symmetry extending from said narrow nose to the midpoint of the trailing edge, ellipse-like cross-sections transverse to said plane through substantially all of the length of the hull, a maximum height dimension in said plane perpendicular to the chord in said plane at a location spaced from said trailing edge and from said nose, said ellipse-like cross-sections progressively decreasing in height, measured in said plane, throughout substantially the entire distance from the cross-section of maximum height toward said trailing edge, and a phased array antenna physically stationary relative to the hull, said antenna being arranged to scan horizontally, while the aircraft is in level flight, in all forward azimuthal directions within an arc of at least 180 degrees symmetrical about said plane of symmetry, and being fixed in a position substantially entirely within the interior of said hull so that substantially all radiant energy received by said antenna passes through said hull.

2. An airborne surveillance platform according to claim 1 in which said antenna comprises a first antenna element arranged to scan through said first leading edge, and a second antenna element arranged to scan through said second leading edge.

3. An airborne surveillance platform according to claim 2 in which said first antenna element is arranged lengthwise along the first leading edge on the inside thereof, and said second antenna element is arranged lengthwise along the second leading edge on the inside thereof.

4. An airborne surveillance platform according to claim 3 in which said first antenna element is situated sufficiently close to said first leading edge, and said second antenna element is situated sufficiently close to said second leading edge, to provide an interior cargo space located within the hull between said antenna elements, the hull having means providing an access opening near said trailing edge leading to said cargo space.

5. An airborne surveillance platform according to claim 3 in which said first antenna element is situated sufficiently close to said first leading edge, and said second antenna element is situated sufficiently close to said second leading edge, to provide an interior cargo space located within the hull between said antenna elements, the hull having means providing an access opening in the underside of the hull near said trailing edge, the access opening leading to said cargo space.

6. An airborne surveillance platform according to claim 3 in which said first and second antenna elements are linear phased arrays.

7. An airborne surveillance platform comprising an aircraft hull having a delta-shaped platform with a narrow nose at one corner, first and second radar-transparent leading edges extending respectively from the nose to the opposite corners, and a trailing edge extending between said opposite corners, the platform being substantially symmetrical about a plane of symmetry extending from said narrow nose to the midpoint of the trailing edge, ellipse-like cross-sections transverse to said plane through substantially all of the length of the hull, a maximum height dimension in said plane perpendicular to the chord in said plane at a location spaced from said trailing edge and from said nose, said ellipse-like cross-sections progressively decreasing in height, measured in said plane, throughout substantially the entire distance from the cross-section of maximum height toward said trailing edge, and a phased array antenna physically stationary relative to the hull and fixed in a position substantially entirely within the interior of said hull so that substantially all radiant energy received by said antenna passes through said hull, the antenna comprising a first linear phased array extending lengthwise along the inside of said first leading edge, and a second linear phased array extending lengthwise along the inside of said second leading edge.

* * * * *

UNITED STATES PATENT AND TRADEMARK OFFICE

CERTIFICATE OF CORRECTION

PATENT NO. : 5,034,751

DATED : July 23, 1991

INVENTOR(S) : William McE. Miller, Jr.

It is certified that error appears in the above-identified patent and that said Letters Patent is hereby corrected as shown below:

On the cover page, column 1, the line "Assignee: Aereon Corporation, Princeton, N.J." should be deleted;

Column 1, line 8, "February 23, 1990" should read --January 23, 1990--;

Column 2, line 10, "platform" should read --planform--;

Column 2, line 13, "platform" should read --planform--;

Column 2, line 29, "palnform" should read --planform--;

Column 2, line 27, "utilized" should read --utilizes--;

Column 2, line 55, "AT" should read --At--;

Column 2, line 66, "t" should read --at--;

Column 6, line 1, "platform" should read --planform--;

Column 7, line 13, "platform" should read --planform--;

Column 8, line 21, "platform" should read --planform--;

UNITED STATES PATENT AND TRADEMARK OFFICE

CERTIFICATE OF CORRECTION

PATENT NO. : 5,034,751

DATED : July 23, 1991

INVENTOR(S) : William McE. Miller,Jr.

It is certified that error appears in the above-identified patent and that said Letters Patent is hereby corrected as shown below:

Column 8, line 25, "platform" should read --planform--;

Signed and Sealed this

Twenty-ninth Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,034,751
DATED : July 23, 1991
INVENTOR(S) : William McE. Miller, Jr.

It is certified that error appears in the above-identified patent and that said Letters Patent is hereby corrected as shown below:

Title page,

Between items [73] and [21], change the notice of disclaimer to read as follows:

-- [*] Notice: The portion of the term of this patent which would extend beyond the expiration date of Patent 4,896,160 has been disclaimed. --

Signed and Sealed this

Twenty-second Day of July, 2003

JAMES E. ROGAN
*Director of the United States Patent and Trademark Office*